US005454855A

United States Patent [19]

Kita et al.

[11] Patent Number: 5,454,855

[45] **Date of Patent: * Oct. 3, 1995**

[54] COMPACTED AND CONSOLIDATED MATERIAL OF ALUMINUM-BASED ALLOY AND PROCESS FOR PRODUCING THE SAME

[75] Inventors: Kazuhiko Kita, Uozu; Hidenobu Nagahama, Kurobe; Takeshi Terabayashi, Nyuzen; Makoto Kawanishi, Kurobe, all of Japan

[73] Assignee: YKK Corporation, Tokyo, Japan

[ * ] Notice: NOTE-DISCLAIMER The portion of the term of this patent subsequent to Nov. 23, 2010 has been disclaimed.

[21] Appl. No.: 967,206

[22] Filed: Oct. 27, 1992

[30] Foreign Application Priority Data

Nov. 1, 1991 [JP] Japan ..... 3-287919

[51] Int. Cl.[6] ..... B22F 3/02; C22C 21/00

[52] U.S. Cl. ..... 75/249; 420/551; 419/66; 419/67; 148/438; 148/439; 148/440; 148/590

[58] Field of Search ..... 75/249; 420/551; 419/66, 67; 148/438, 439, 440, 450

[56] References Cited

U.S. PATENT DOCUMENTS

| | | | |
|---|---|---|---|
| 3,020,154 | 2/1962 | Ida | 420/551 |
| 4,950,452 | 8/1990 | Masumoto et al. | 420/550 |
| 5,264,021 | 11/1993 | Kita et al. | 75/249 |
| 5,279,642 | 1/1994 | Ohtera | 75/351 |
| 5,334,266 | 8/1994 | Kawanishi et al. | 148/403 |

FOREIGN PATENT DOCUMENTS

| | | |
|---|---|---|
| 0475101A1 | 3/1992 | European Pat. Off. . |
| 4-154933 | 5/1992 | Japan . |

OTHER PUBLICATIONS

Chemical Abstracts, vol. 118, Abstract No. 10386 of JP–A–4–154933, Hiroyuki Horimura, "Manufacture of Aluminum Alloys having High Strength and Toughness".

*Primary Examiner*—Ngoclan Mai

*Attorney, Agent, or Firm*—Flynn, Thiel, Boutell & Tanis

[57] ABSTRACT

A compacted and consolidated material of an aluminum-based alloy obtained by compacting and consolidating a rapidly solidified material having a composition represented by the general formula: $Al_aNi_bX_cM_d$, $Al_aNi_bX_cQ_e$ or $Al_a'Ni_bX_cM_dQ_e$, wherein X represents at least one element selected from the group consisting of La, Ce, Mm (misch metal), Ti and Zr; M represents at least one element selected from the group consisting of V, Cr, Mn, Fe, Co, Y, Nb, Mo, Hf, Ta and W; Q represents at least one element selected from the group consisting of Mg, Si, Cu and Zn; and a, a', b, c, d and e are, in atomic percentages, $85 \leqq a \leqq 94.4$, $83 \leqq a \leqq 94.3$, $5 \leqq b \leqq 10$, $0.5 \leqq c \leqq 3$, $0.1 \leqq d \leqq 2$ and $0.1 \leqq e \leqq 2$. The material is produced by melting a material having the above specified composition, quench-solidifying the melt, compacting the resultant powder or flakes, and subjecting the thus-compacted material to press forming and consolidating by a conventional plastic working technique.

10 Claims, 3 Drawing Sheets

COMPACTED AND CONSOLIDATED MATERIAL OF ALUMINUM-BASED ALLOY AND PROCESS FOR PRODUCING THE SAME

BACKGROUND OF THE INVENTION

1. Field of the Invention

The present invention relates to a compacted and consolidated material of an aluminum-based alloy having a high strength and capable of withstanding practical working, and also to a process for the production of the material.

2. Description of the Prior Art

An aluminum-based alloy having a high strength and a high heat resistance has heretofore been produced by, for example, a liquid quenching process and such an aluminum alloy is disclosed, for example, in Japanese Patent Laid-Open No. 275732/1989. The aluminum alloy produced by the liquid quenching process is amorphous or microcrystalline and is an excellent alloy having a high strength, a high heat resistance and a high corrosion resistance.

The above-described aluminum-based alloy is an alloy having a high strength, a heat resistance and a high corrosion resistance. This aluminum-based alloy is excellent also in workability when it is prepared in a powder or flake form by a liquid quenching process and, then, subjected as a raw material to various working techniques to give a final product, that is, when a product is prepared through primary working only. However, when a consolidated material is formed through the use of the powder or flakes as the raw material and, then, further worked, that is, subjected to secondary working, there is room for improvement in the workability and maintenance of excellent properties of the material after the working.

SUMMARY OF THE INVENTION

Accordingly, an object of the present invention is to provide a compacted and consolidated material of an aluminum-based alloy consisting of a particular composition that permits easy working when subjecting the material to secondary working (extrusion, cutting, forging, etc.) and allows the retaining of the properties inherent in the raw material, even after the working.

The first aspect provides a compacted and consolidated material of an aluminum-based alloy which has been produced by compacting and consolidating a rapidly solidified material having a composition represented by the general formula: $Al_aNi_bX_cM_d$, wherein X represents at least one element selected from the group consisting of La, Ce, Mm (misch metal), Ti and Zr; M represents at least one element selected from the group consisting of V, Cr, Mn, Fe, Co, Y, Nb, Mo, Hf, Ta and W; and a, b, c and d are, in atomic percentages, $85 \leqq a \leqq 94.4$, $5 \leqq b \leqq 10$, $0.5 \leqq c \leqq 3$ and $0.1 \leqq d \leqq 2$.

The second aspect provides a compacted and consolidated material of an aluminum-based alloy which has been produced by compacting and consolidating a rapidly solidified material having a composition represented by the general formula: $Al_aNi_bX_cQ_e$, wherein X represents at least one element selected from the group consisting of La, Ce, Mm, Ti and Zr; Q represents at least one element selected from the group consisting of Mg, Si, Cu and Zn; and a, b, c and e are, in atomic percentages, $85 \leqq a \leqq 94.4$, $5 \leqq b \leqq 10$, $0.5 \leqq c \leqq 3$ and $0.1 \leqq e \leqq 2$.

The third aspect provides a compacted and consolidated material of an aluminum-based alloy which has been produced by compacting and consolidating a rapidly solidified material having a composition represented by the general formula: $Al_{a'}Ni_bX_cM_dQ_e$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; Q represents at least one element selected from the group consisting of Mg, Si, Cu and Zn; and a', b, c, d and e are, in atomic percentages, $83 \leqq a' \leqq 94.3$, $5 \leqq b \leqq 10$, $0.5 \leqq c \leqq 3$, $0.1 \leqq d \leqq 2$ and $0.1 \leqq e \leqq 2$.

The fourth aspect provides a process for producing a compacted and consolidated material of an aluminum-based alloy, the process comprising:

melting a material having a composition represented by the general formula: $Al_aNi_bX_cM_d$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; and a, b, c and d are, in atomic percentages, $85 \leqq a \leqq 94.4$, $5 \leqq b \leqq 10$, $0.5 \leqq c \leqq 3$ and $0.1 \leqq d \leqq 2$;

quench-solidifying the melt;

compacting the resultant powder or flakes; and subjecting the thus-compacted powder or flakes to press forming-consolidation by a conventional plastic working technique.

The fifth aspect provides a process for producing a compacted and consolidated material of an aluminum-based alloy, the process comprising:

melting a material having a composition represented by the general formula: $Al_aNi_bX_cQ_e$, wherein X represents at least one element selected from the group consisting of La, Ce, Mm, Ti and Zr; Q represents at least one element selected from the group consisting of Mg, Si, Cu and Zn; and a, b, c and e are, in atomic percentages, $85 \leqq a \leqq 94.4$, $5 \leqq b \leqq 10$, $0.5 \leqq c \leqq 3$ and $0.1 \leqq e \leqq 2$;

quench-solidifying the melt;

compacting the resultant powder or flakes; and subjecting the thus-compacted powder or flakes to press forming -consolidation by a conventional plastic working technique.

The sixth aspect provides a process for producing a compacted and consolidated material of an aluminum-based alloy, the process comprising:

melting a material having a composition represented by the general formula: $Al_{a'}Ni_bX_cM_dQ_e$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; Q represents at least one element selected from the group consisting of Mg, Si, Cu and Zn; and a', b, c, d and e are, in atomic percentages, $83 \leqq a' \leqq 94.3$, $5 \leqq b \leqq 10$, $0.5 \leqq c \leqq 3$, $0.1 \leqq d \leqq 2$ and $0.1 \leqq e \leqq 2$;

quench-solidifying the melt;

compacting the resultant powder or flakes; and subjecting the thus-compacted powder or flakes to press forming -consolidation by a conventional plastic working technique.

The above-described consolidated material preferably consists of a matrix formed of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, the intermetallic compounds having a mean particle size of 10 to 800 nm.

In the fourth, fifth and sixth aspects, the powder or flakes as the raw material should be composed of an amorphous phase structure, a supersaturated solid solution structure, the above-described microcrystalline structure wherein the mean crystal grain size of the matrix is 1000 nm or less and the mean particle size of the dispersed intermetallic compounds is 1 to 800 nm, or a mixed phase structure consisting of the above-described structures. When the material is amorphous, it can be converted into a microcrystalline structure or a mixed phase structure satisfying the above-described requirements by heating it to 50° to 400° C.

The above-described conventional plastic working technique should be interpreted in a broad sense and includes press-forming and powder metallurgy techniques.

DETAILED DESCRIPTION OF THE PREFERRED EMBODIMENTS

Figure 1:
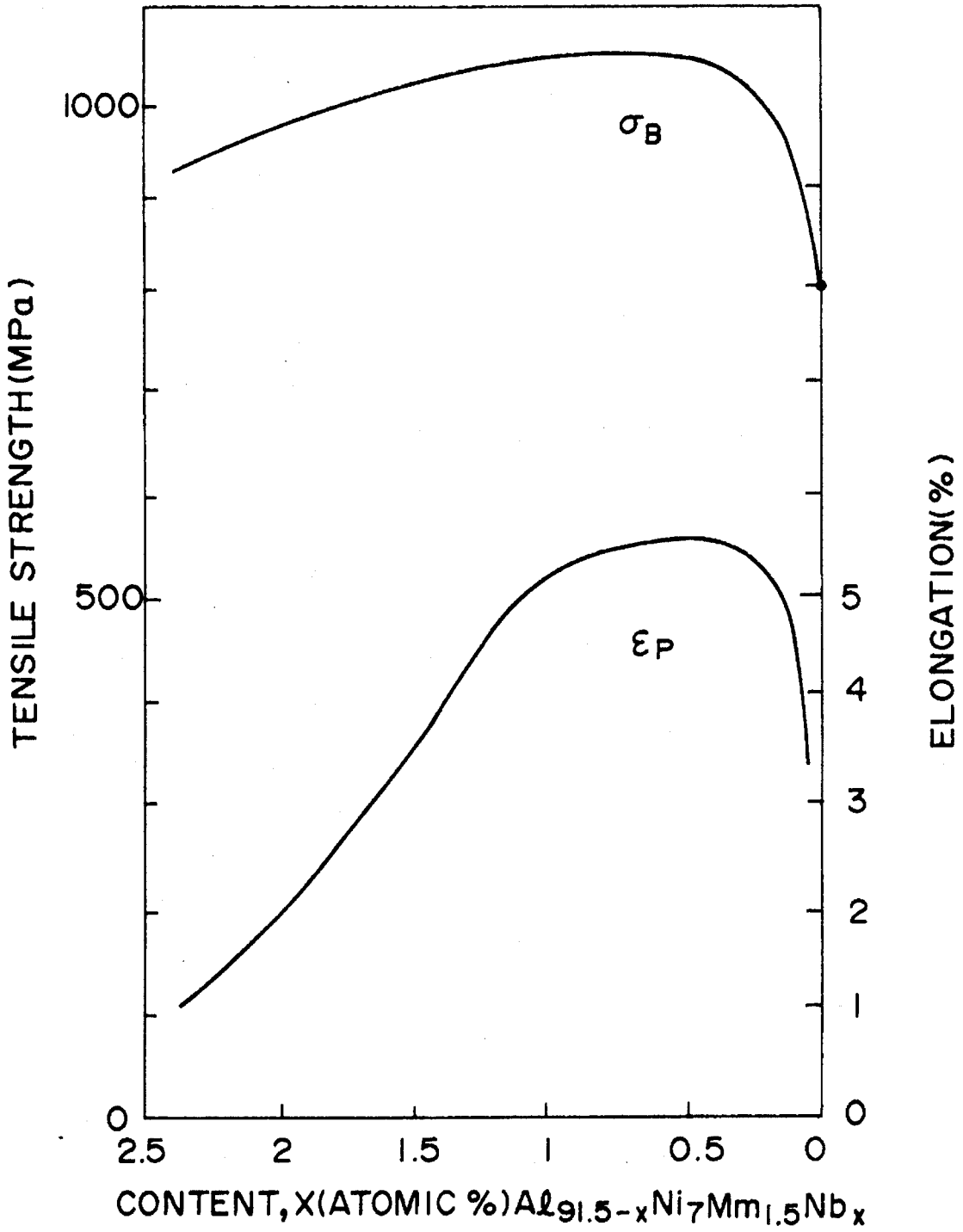
FIG. 1 is a graph showing the relationship between the elongation ($\epsilon_p$) and the tensile strength ($\sigma_B$) at room temperature of a consolidated material of a Nb-containing alloy in Example 1 depending on the change in the Nb content.

In the above-described general formula, the values of a, a', b, c, d and e were limited to, in atomic percentages, 85 to 94.4%, 83 to 94.3%, 5 to 10%, 0.5 to 3%, 0.1 to 2% and 0.1 to 2%, respectively, because when these values are in the above-described respective ranges, the material has a higher strength at room temperature to 300° C. than that of the conventional (commercially available) high-strength aluminum alloy and a ductility sufficient to permit practical working.

In the consolidated material of the alloy according to the present invention, Ni is an element having a relatively small diffusibility in an Al matrix and, when finely dispersed as an intermetallic compound in the Al matrix, it has the effect of strengthening the matrix and regulating the growth of a crystal grain. Specifically, it can remarkably improve the hardness and strength of the alloy and stabilize the microcrystalline phase not only at room temperature but also at high temperature, so that heat resistance is imparted.

The element X is at least one element selected from the group consisting of La, Ce, Mm, Ti and Zr. It has a small diffusibility in the Al matrix and forms various metastable or stable intermetallic compounds, which contributes to the stabilization of the microcrystalline structure.

Further, the above-described combination of the elements enables ductility necessary for the existing working to be imparted. Mm (misch metal) is a common name of a composite comprising La and Ce as major elements and further rare earth (lanthanoid) elements other than La and Ce and unavoidable impurities (Si, Fe, Mg, Al, etc.). Mm can be substituted for La and Ce in a ratio of 1:1 (atomic %) and is inexpensive, which is very advantageous from the viewpoint of the profitability.

The element M is at least one element selected from the group consisting of V, Cr, Mn, Fe, Co, Y, Nb, Mo, Hf, Ta and W. This element combines with Al to form compounds which have a size of 10 to 100 nm, which is smaller than that of Al-Ni-based and Al-X-based intermetallic compounds and are homogeneously and finely dispersed between the above-described compounds. The Al-M-based compounds pin the dislocation to relax stress concentration, thus improving the ductility. When the element M is added in a very small amount, the element M which has been dissolved in Al as a solid solution precipitates as an Al-M-based metallic compound in a quenched state during warm working (powder pressing, extrusion, forging, etc.), so that it can be finely dispersed. The addition of the element M enables better toughness (ductility) and heat resistance to be attained. When the amount of addition exceeds 2 atomic %, an excellent effect can be expected in the heat resistance and strength, but the ductility, which is an object of the present invention, becomes insufficient.

The element Q is at least one element selected from the group consisting of Mg, Si, Cu and Zn. It combines with Al or another element Q to form compounds which strengthen the matrix and, at the same time, improves the heat resistance. Further, the specific strength and the specific elasticity can be improved.

In the consolidated material of an aluminum-based alloy according to the present invention, the mean crystal grain size of the matrix is limited to 40 to 1000 nm for the following reason. When the mean crystal grain size is less than 40 nm, the ductility is insufficient, though the strength is high. Thus, in order to attain a ductility necessary for existing working, it is necessary that the mean crystal grain size be 40 nm or more. When the mean crystal grain size exceeds 1000 nm, on the other hand the strength lowers so rapidly that no consolidated material having a high strength can be prepared. Thus, in order to prepare a consolidated material having a high strength, it is necessary that the mean crystal grain size be 1000 nm or less. The mean particle size of the intermetallic compounds is limited to 10 to 800 nm, because when it is outside the above-described range, the intermetallic compounds do not serve as an element for strengthening the Al matrix. Specifically, when the mean particle size is less than 10 nm, the intermetallic compounds do not contribute to the strengthening of the A1 matrix. In this case, when the intermetallic compounds are excessively dissolved in the matrix as a solid solution, there is a possibility that the material becomes brittle. On the other hand, when the mean particle size exceeds 800 nm, the size of the dispersed particles become excessively large. Consequently, the strength cannot be maintained and the intermetallic compounds cannot serve as a strengthening element. When the mean particle size is in the above-described range, it becomes possible to improve the Young's modulus, high-temperature strength and fatigue strength.

In the consolidated material of an aluminum-based alloy according to the present invention, the mean crystal grain size of the matrix, the mean particle size of the dispersed intermetallic compounds and the state of dispersion of the intermetallic compounds can be regulated through proper selection of production conditions. When importance is given to strength, the mean crystal grain size of the matrix and the mean particle size of the intermetallic compounds are regulated so as to become small. On the other hand, when importance is given to the ductility, the mean crystal grain size and the mean particle size of the intermetallic compounds are regulated so as to become large. Thus, consolidated materials suitable for various purposes can be prepared.

Further, excellent properties necessary as a superplastic working material can be imparted through the regulation of the mean crystal grain size of the matrix in the range of from 40 to 1000 nm.

The present invention will now be described in more detail with reference to the following Examples.

EXAMPLE 1

Aluminum-based alloy powders ($Al_{91.5-x}Ni_7Mm_{1.5}Nb_x$ and $Al_{90-x}Ni_8Mm_2Cr_x$), each having a predetermined composition, were prepared by using a gas atomizing apparatus. Each aluminum-based alloy powder thus produced was filled in a metallic capsule to prepare a billet for extrusion with degassing on a vacuum hot press. This billet was extruded at a temperature of 200° to 550° C. on an extruder. The mechanical properties (tensile strength, elongation) at room temperature of the extruded material (consolidated material) produced under the above-described production conditions are shown in FIGS. 1 and 2.

Figure 2:
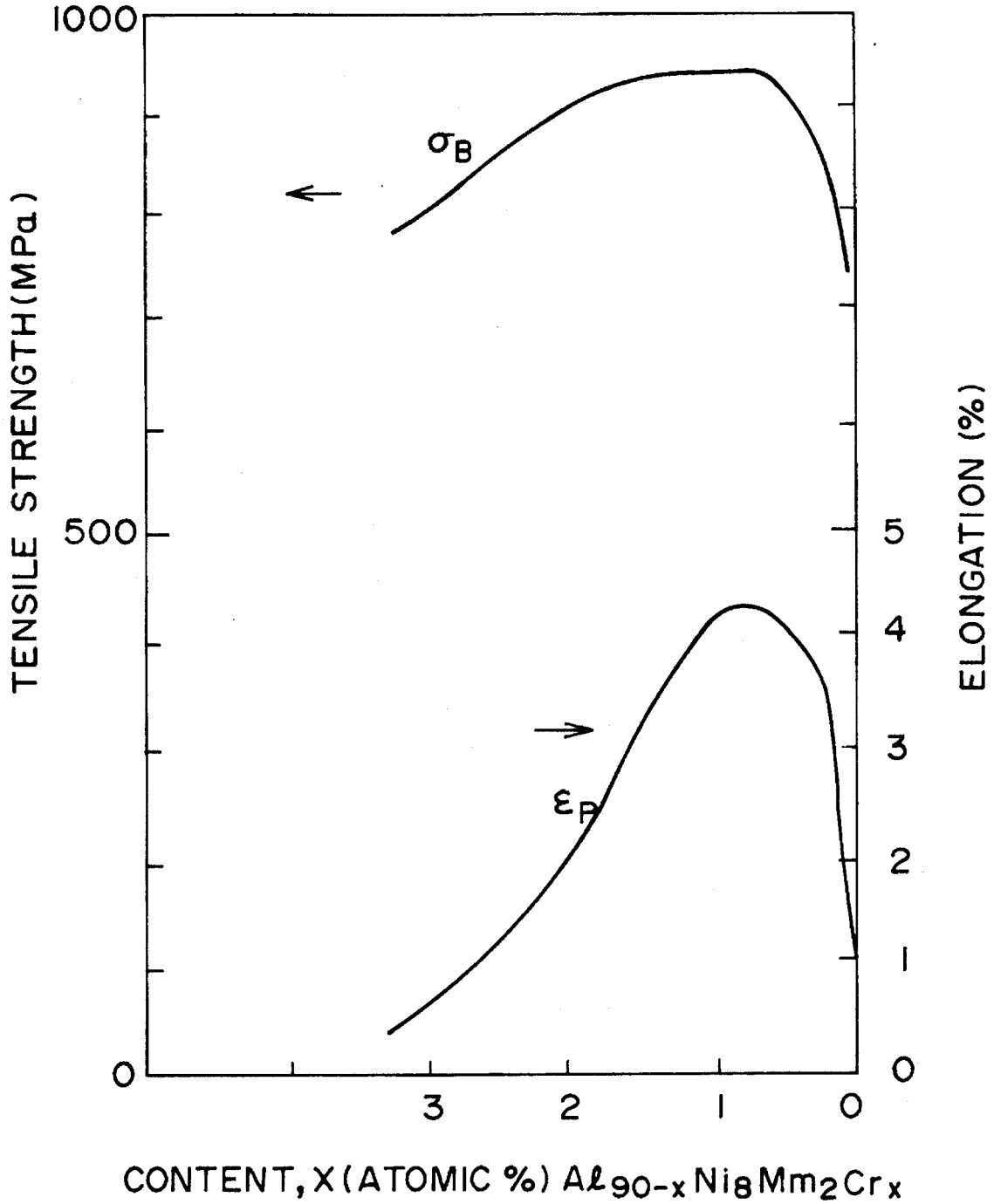
FIG. 2 is a graph showing the relationship between the elongation ($\epsilon_p$) and the tensile strength ($\sigma_B$) at room temperature of a consolidated material of a Cr-containing alloy in Example 1 depending on the change in the Cr content.

As is apparent from FIGS. 1 and 2, the tensile strength $\sigma_B$ of the consolidated material at room temperature rapidly lowers when the Nb content or the Cr content is 0.2 atomic % or less. Further, it is apparent that the minimum elongation $\epsilon_p$ (2%) necessary for general working is obtained when the Nb content or the Cr content is not more than 2 atomic %. Therefore, cold working (working around room temperature) of a formed material having a high strength can be conducted when the Nb content or the Cr content is in the range of from 0 to 2 atomic %. For comparison, the tensile strength at room temperature of the conventional high-strength, material of an aluminum-based alloy (extruded material of duralumin) was measured and found to be 650 MPa. From this result as well, it is apparent that the consolidated material of the present invention has an excellent strength.

The consolidated material produced under the above-described production conditions was subjected to the measurement of Young's modulus. As a result, the Young's modulus of the consolidated material according to the present invention was 8500 to 12000 kgf/mm$^2$, which was higher than the Young's modulus of the conventional high-strength Al alloy (duralumin), that is, 7000 kgf/mm$^2$. This brings about such an effect that when an identical load is applied, the degree of deflection and the degree of deformation are smaller.

EXAMPLE 2

Figure 3:
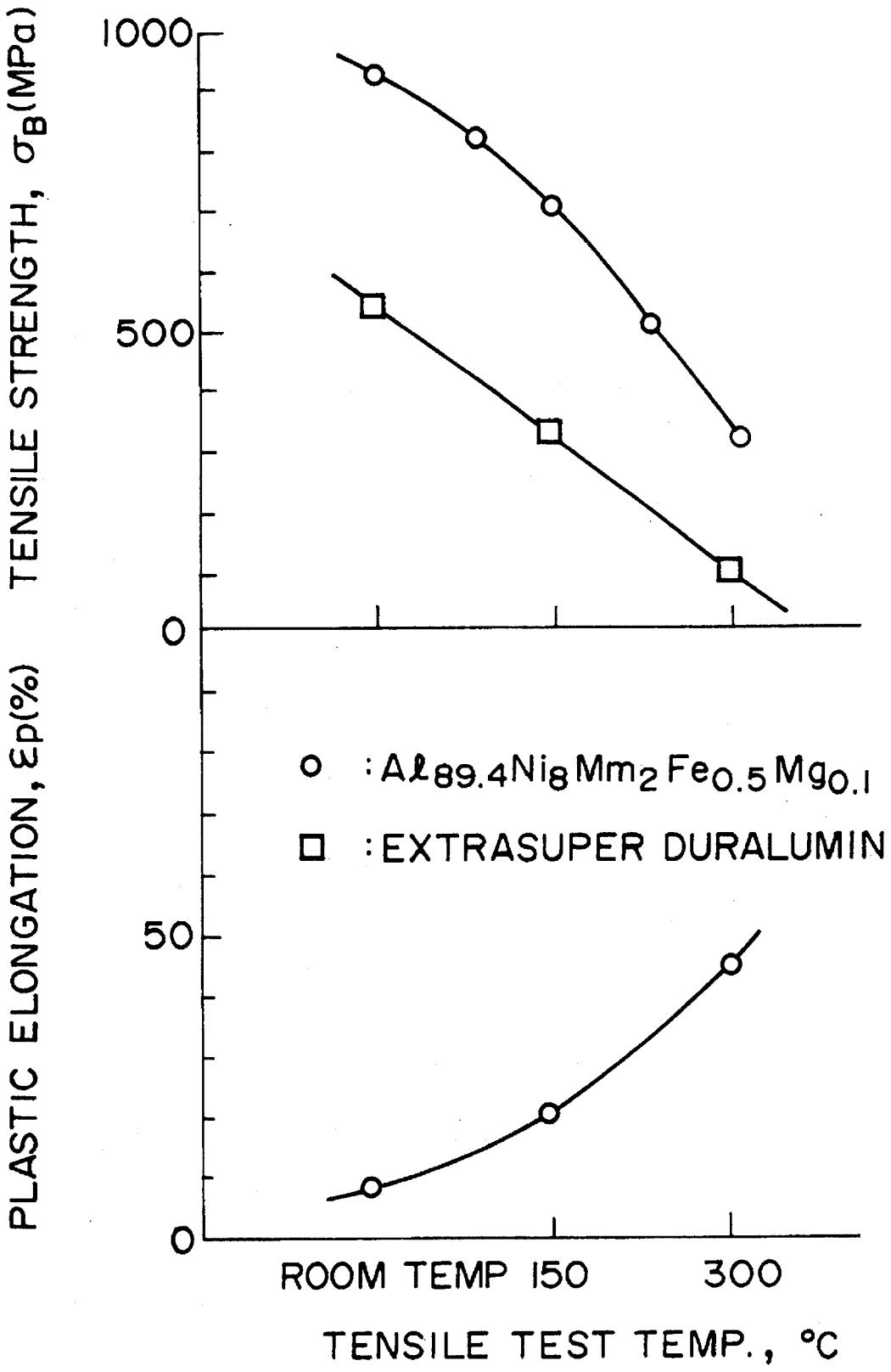
FIG. 3 is a graph showing the relationship between the temperature in the range of from room temperature to 300° C. and the mechanical properties for a consolidated material of Example 2 and the conventional material.

An extruded material (a consolidated material), $Al_{89.4}Ni_8Mm_2Fe_{0.5}Mg_{0.1}$, produced under the same conditions as that of Example 1, was subjected to the measurement of mechanical properties (tensile strength, elongation) at a given temperature after it was held at a given temperature for 100 hr. The relationship between the temperature and the mechanical properties is shown in FIG. 3. For comparison, the conventional high-strength material of an aluminum-based material (extruded material of extrasuper duralumin) was subjected to the same measurement as that described above.

As shown in FIG. 3, the consolidated material of an alloy according to the present invention has a high tensile strength at a temperature in the range of from room temperature to 300° C., and the tensile strength at a temperature in the range of from room temperature to 300° C. is higher than that of extrasuper duralumin, which is the conventional high-strength aluminum-based alloy material. Further, it is apparent that the consolidated material of an alloy according to the present invention exhibits an excellent elongation despite a high tensile strength.

EXAMPLE 3

Extruded materials (consolidated materials) having compositions (atomic %) specified in Table 1 were prepared under the same production conditions as those of Example 1 and subjected to the measurements of tensile strength at room temperature, elongation at room temperature, and tensile strength at 473 K (200° C.) as given in the right column of Table 1. The tensile strength at 473 K was measured by holding the resultant extruded material at 473 K for 100 hours and measuring the tensile strength at 473 K.

From the results shown in Table 1, it is apparent that the extruded materials of the present invention exhibit an excellent tensile strength at a temperature in the range of from room temperature to 473 K and an excellent elongation.

TABLE 1

| | Composition (atomic %) | | | | | $\sigma_B$ room temp. | Elongation | $\sigma_B$ 473K |
|---|---|---|---|---|---|---|---|---|
| | Al | Ni | X | M | Q | (MPa) | (%) | (MPa) |
| Invention Ex. 1 | balance | 10 | Mm = 0.5, Ti = 0.2 | Cr = 0.1 | | 1034 | 4.4 | 622 |
| Invention Ex. 2 | balance | 10 | Mm = 1.0 | V = 0.3 | Mg = 0.1 | 987 | 4.3 | 611 |
| Invention Ex. 3 | balance | 9 | Mm = 1.5 | Cr = 0.2 | | 953 | 4.3 | 634 |
| Invention Ex. 4 | balance | 9 | Mm = 2.0 | Mn = 0.5 | Si = 0.5 | 977 | 4.7 | 607 |
| Invention Ex. 5 | balance | 9 | Zr = 2.5 | Fe = 1.0 | | 962 | 5.1 | 625 |
| Invention Ex. 6 | balance | 8 | Mm = 3.0 | Co = 0.7 | | 890 | 4.9 | 637 |
| Invention Ex. 7 | balance | 8 | Mm = 2.5 | Y = 1.5 | Mg = 1.0, Si = 0.5 | 920 | 4.7 | 640 |
| Invention Ex. 8 | balance | 8 | Mm = 1.5, Zr = 0.3 | W = 0.3 | | 877 | 4.5 | 600 |
| Invention Ex. 9 | balance | 8 | Ti = 1.0 | Nb = 0.4 | Cu = 0.4 | 867 | 5.5 | 612 |
| Invention Ex. 10 | balance | 7 | Mm = 2.5 | Mo = 1.0 | | 912 | 5.8 | 597 |
| Invention Ex. 11 | balance | 7 | Mm = 2.0 | Hf = 1.2 | Mg = 0.2, Zn = 0.1 | 920 | 6.2 | 607 |
| Invention Ex. 12 | balance | 7 | Mm = 1.5 | Ta = 0.2, Mn = 0.3 | | 937 | 4.6 | 610 |
| Invention Ex. 13 | balance | 7 | La = 1.0 | W = 1.8 | | 911 | 5.7 | 625 |
| Invention Ex. 14 | balance | 6 | Mm = 3.0 | V = 0.8 | | 854 | 6.4 | 597 |
| Invention Ex. 15 | balance | 6 | Mm = 2.0 | Y = 1.0 | | 870 | 5.3 | 635 |
| Invention Ex. 16 | balance | 6 | Ce = 1.5 | Mo = 1.2 | | 972 | 6.4 | 622 |

TABLE 1-continued

| | Composition (atomic %) | | | | | $\sigma_B$ room temp. | Elon-gation | $\sigma_B$ 473K |
|---|---|---|---|---|---|---|---|---|
| | Al | Ni | X | M | Q | (MPa) | (%) | (MPa) |
| Invention Ex. 17 | balance | 5 | Mm = 2.0 | Mn = 0.4, Cr = 1.0 | Si = 1.5 | 879 | 5.7 | 599 |
| Invention Ex. 18 | balance | 5 | Mm = 1.5 | Ta = 1.6 | | 912 | 6.8 | 612 |
| Invention Ex. 19 | balance | 5 | Zr = 2.0 | Cr = 0.3 | Mg = 0.3, Zn = 0.1 | 872 | 7.4 | 576 |
| Invention Ex. 20 | balance | 10 | Mm = 1.0 | | Mg = 0.1 | 962 | 4.2 | 609 |
| Invention Ex. 21 | balance | 9 | Mm = 1.5 | | Cu = 0.7 | 958 | 4.7 | 617 |
| Invention Ex. 22 | balance | 8 | Mm = 2.5 | | Si = 1.0 | 925 | 4.6 | 607 |
| Invention Ex. 23 | balance | 7 | Ti = 2.2 | | Mg = 1.7 | 917 | 5.2 | 625 |
| Invention Ex. 24 | balance | 6 | Zr = 2.5 | | Cu = 1.2 | 897 | 4.1 | 617 |
| Invention Ex. 25 | balance | 5 | Mm = 2.5 | | Zn = 0.7 | 870 | 6.2 | 575 |

As described above, the consolidated material of an aluminum-based alloy according to the present invention exhibits an excellent toughness in the subsequent steps of working and enables the working to be easily conducted and, at the same time, excellent properties inherent in a rapidly solidified material before consolidation to be maintained.

Further, the amount of addition of an element having a high specific gravity is so small that it is possible to provide an alloy material having a high specific strength.

Further, the consolidated material can be prepared by a simple process which comprises compacting powder or flakes produced by quench solidification and subjecting the thus-compacted powder or flakes to plastic working.

What is claimed is:

1. A compacted and consolidated material of an aluminum-based alloy which has been produced by compacting and consolidating a rapidly solidified material having a composition represented by the general formula: $Al_aNi_bX_cM_d$, wherein X represents at least one element selected from the group consisting of La, Ce, Mm (misch metal), Ti and Zr; M represents at least one element selected from the group consisting of V, Cr, Mn, Fe, Co, Y, Nb, Mo, Hf, Ta and W; and a, b, c and d are, in atomic percentages, $85 \leqq a \leqq 94.4$, $5 \leqq b \leqq 10$, $0.5 \leqq c \leqq 3$ and $0.1 \leqq d \leqq 2$, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

2. A compacted and consolidated material of an aluminum-based alloy which has been produced by compacting and consolidating a rapidly solidified material having a composition represented by the general formula: $Al_aNi_bX_cQ_e$, wherein X represents at least one element selected from the group consisting of La, Ce, Mm, Ti and Zr; Q represents at least one element selected from the group consisting of Mg, Si, Cu and Zn; and a, b, c and e are, in atomic percentages, $85 \leqq a \leqq 94.4$, $5 \leqq b \leqq 10$, $0.5 \leqq c \leqq 3$ and $0.1 \leqq e \leqq 2$, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

3. A compacted and consolidated material of an aluminum-based alloy which has been produced by compacting and consolidating a rapidly solidified material having a composition represented by the general formula: $Al_{a'}Ni_bX_cM_dQ_e$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; Q represents at least one element selected from the group consisting of Mg, Si, Cu and Zn; and a', b, c, d and e are, in atomic percentages, $83 \leqq a' \leqq 94.3$, $5 \leqq b \leqq 10$, $0.5 \leqq c \leqq 3$, $0.1 \leqq d \leqq 2$ and $0.1 \leqq e \leqq 2$, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

4. A process for producing a compacted and consolidated material of an aluminum-based alloy, the process comprising:

melting a material having a composition represented by the general formula: $Al_aNi_bX_cM_d$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; and a, b, c and d are, in atomic percentages, $85 \leqq a \leqq 94.4$, $5 \leqq b \leqq 10$, $0.5 \leqq c \leqq 3$ and $0.1 \leqq d \leqq 2$;

quench-solidifying the melt;

compacting a resultant powder or flakes; and subjecting the thus-compacted powder or flakes to press forming-consolidation by a conventional plastic working technique, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

5. A process for producing a compacted and consolidated material of an aluminum-based alloy, the process comprising:

melting a material having a composition represented by the general formula: $Al_aNi_bX_cQ_e$, wherein X represents at least one element selected from the group consisting of La, Ce, Mm, Ti and Zr; Q represents at least one element selected from the group consisting of Mg, Si, Cu and Zn; and a, b, c and e are, in atomic percentages, $85 \leqq a \leqq 94.4$, $5 \leqq b \leqq 10$, $0.5 \leqq c \leqq 3$ and $0.1 \leqq e \leqq 2$;

quench-solidifying the melt;

compacting a resultant powder or flakes; and subjecting the thus-compacted powder or flakes to press forming-consolidation by a conventional plastic working technique, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

6. A process for producing a compacted and consolidated material of an aluminum-based alloy, the process comprising:

melting a material having a composition represented by the general formula: $Al_{a'}Ni_bX_cM_dQ_e$, wherein X represents at least one element selected from the group consisting of La, Ce, Mm, Ti and Zr; M represents at least one element selected from the group consisting of V, Cr, Mn, Fe, Co, Y, Nb, Mo, Hf, Ta and W; Q represents at least one element selected from the group consisting of Mg, Si, Cu and Zn; and a', b, c, d and e are, in atomic percentages, $83 \leqq a' \leqq 94.3$, $5 \leqq b \leqq 10$, $0.5 \leqq c \leqq 3$, $0.1 \leqq d \leqq 2$ and $0.1 \leqq e \leqq 2$;

quench-solidifying the melt;

compacting a resultant powder or flakes; and subjecting the thus-compacted powder or flakes to press forming-consolidation by a conventional plastic working technique, said material consisting of a matrix of aluminum or a supersaturated solid solution of aluminum whose mean crystal grain size is 40 to 1000 nm and particles which are composed of a stable phase or a metastable phase of various intermetallic compounds formed from the matrix element and other alloying elements and/or various intermetallic compounds formed from other alloying elements themselves and homogeneously distributed in said matrix, said intermetallic compounds having a mean particle size of 10 to 800 nm.

7. A compacted and consolidated material of an aluminum-based alloy according to claim 1, wherein X is Mm and M is Nb.

8. A compacted and consolidated material of an aluminum-based alloy according to claim 1, wherein X is Mm and M is Cr.

9. A process for producing a compacted and consolidated material of an aluminum-based alloy according to claim 4, wherein X is Mm and M is Nb.

10. A process for producing a compacted and consolidated material of an aluminum-based alloy according to claim 4, wherein X is Mm and M is Cr.

* * * * *